US006637980B2

(12) United States Patent
Robertson, Jr.

(10) Patent No.: US 6,637,980 B2
(45) Date of Patent: Oct. 28, 2003

(54) METHOD AND APPARATUS FOR RE-TENSIONING A ROOF BOLT IN AN UNDERGROUND MINE

(75) Inventor: Roy Lee Robertson, Jr., Delbarton, WV (US)

(73) Assignee: Earl Products, Inc., Proctorville, OH (US)

( * ) Notice: Subject to any disclaimer, the term of this patent is extended or adjusted under 35 U.S.C. 154(b) by 0 days.

(21) Appl. No.: 09/992,415

(22) Filed: Nov. 23, 2001

(65) Prior Publication Data

US 2002/0064429 A1 May 30, 2002

Related U.S. Application Data

(60) Provisional application No. 60/253,068, filed on Nov. 25, 2000.

(51) Int. Cl.[7] ..... E21D 21/00; E21D 20/00

(52) U.S. Cl. ..... 405/259.1; 405/258.1; 405/259.2; 405/259.5

(58) Field of Search ..... 405/259.1, 259.2, 405/259.4–259.6, 258.1; 411/267–270, 383, 385, 433, 437

(56) References Cited

U.S. PATENT DOCUMENTS

| | | | | | |
|---|---|---|---|---|---|
| 1,375,781 | A | * | 4/1921 | De Long | 411/437 |
| 1,637,771 | A | | 8/1927 | Haug | |
| 2,725,843 | A | | 12/1955 | Koski | |
| 2,931,264 | A | * | 4/1960 | Dallman | 411/366.1 |
| 3,304,829 | A | | 2/1967 | Raynovich, Jr. | |
| 4,564,315 | A | | 1/1986 | Rozanc | 405/261 |
| 4,704,053 | A | | 11/1987 | Hipkins, Sr. et al. | 405/261 |
| 4,773,490 | A | | 9/1988 | McSweeney et al. | 175/320 |
| 4,784,530 | A | | 11/1988 | Price, Jr. | 405/259 |
| 4,975,014 | A | | 12/1990 | Rufin et al. | 411/385 |
| 4,978,261 | A | * | 12/1990 | Wright, III | 411/433 X |
| 5,042,961 | A | | 8/1991 | Scott et al. | 405/261 |
| 5,064,311 | A | | 11/1991 | Giroux et al. | 405/259 |
| 5,073,065 | A | | 12/1991 | Kleineke | 405/259 |
| 5,074,731 | A | * | 12/1991 | Schneider | 411/437 |
| 5,417,520 | A | | 5/1995 | Rastall | 405/259.6 |
| 5,511,909 | A | | 4/1996 | Calandra, Jr. et al. | 406/259.6 |
| 5,544,982 | A | | 8/1996 | Seegmiller | 405/288 |
| 5,584,611 | A | | 12/1996 | Clonch | 405/299 |
| 5,733,069 | A | | 3/1998 | Schofield, Jr. | 405/259.1 |
| RE35,902 | E | | 9/1998 | Calandra, Jr. et al. | 405/302.1 |
| 5,921,734 | A | * | 7/1999 | Kataoka | 411/269 |
| 5,967,703 | A | | 10/1999 | Stankus et al. | 405/302.2 |
| 6,039,509 | A | | 3/2000 | Locotos | 405/302.2 |
| 6,146,076 | A | * | 11/2000 | Bodin | 411/433 |
| 6,168,361 | B1 | * | 1/2001 | Adler | 411/433 |
| 6,273,646 | B1 | * | 8/2001 | Shaw | 405/259.1 |
| 6,443,497 | B1 | * | 9/2002 | Gravison | 411/433 X |

FOREIGN PATENT DOCUMENTS

| | | | | |
|---|---|---|---|---|
| CH | 610623 | * | 4/1979 | 405/259.1 |
| DE | 3145923 | * | 6/1983 | 405/259.1 |

* cited by examiner

*Primary Examiner*—Jong-Suk Lee
(74) *Attorney, Agent, or Firm*—Waters Law Office, PLLC; Robert R. Waters

(57) ABSTRACT

A method and apparatus of re-tightening or retensioning a roof bolt in an underground mine serves the purpose of enabling the operator to place tension between the head of a permanent, epoxy-secured, roof bolt and the roof plate of a standard roof bolt system used to effect primary roof support in an underground mine. The method and apparatus have particular utility in mines in which drawrock or localized crumbling of shale of soft rock material is encountered as the first layer of material in the mine roof. The apparatus consists of a slotted screw member and slotted nut combination. A second embodiment of the apparatus is comprised of a slotted nut, slotted screw member, and one or more slotted spacers to be oriented between the roof bolt head and base plate. The members are turned with the appropriate tightening tool such as to apply pressure between the base plate and roof bolt head, thereby re-tensioning the roof bolt. The method of the present invention includes the steps outlined above for placement and use of the apparatus in an underground mine.

12 Claims, 4 Drawing Sheets

METHOD AND APPARATUS FOR RE-TENSIONING A ROOF BOLT IN AN UNDERGROUND MINE

CROSS REFERENCE TO RELATED APPLICATIONS

This application claims priority from U.S. provisional application No. 60/253,068, filed on Nov. 25, 2000. That application related to a method and apparatus for re-tightening a roof bolt that has become loose in an underground mine. The entire disclosure contained in U.S. provisional application No. 60/253,068, including the attachments thereto, is incorporated herein by reference.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

In an underground mine, providing and maintaining adequate support for the mine roof is of paramount importance. The majority of serious or fatal accidents occurring in underground mines in the United States over the years have resulted from an inability to control the roof of the mine. While accidents involving major cave-ins of mine roofs have become less prevalent over the years, it is important to note that a fatal accident can occur from the falling of even one large rock from the roof of a mine. Accordingly, mine roof control systems must be completely effective in order to provide safety for personnel working in the mines. The Mine Safety and Health Administration (MSHA) is empowered by the United States government to enforce mine safety standards, including roof support standards, and to provide inspection of mine roof control plans and practices carried out in the mining industry.

As a result of greater emphasis on safety and roof support, serious accidents involving major roof cave-ins have decreased substantially since the 1970s. In order to comply with MSHA standards, underground mines must have a roof control plan in place, and such plan will invariably include provisions for what is known as "primary roof support." Primary roof support refers to abatement provisions designed to prevent a roof cave-in by effectively sealing the lowest layers of a mine roof to upper strata of rock. The most common and effective means for attaching lower level rock strata to upper layers is to utilize a roof bolt and epoxy resin to seal the various layers of rock strata. Roof bolts vary in length and diameter but are typically one-half inch or more in diameter and 30 inches to 12 feet long or longer in overall length. To place a roof bolt in a roof ceiling, a motorized roof bolter, such as that manufactured commercially by such companies as Fletcher Mining Equipment Company, is positioned in the front, unprotected face of the mine and features a drilling mechanism to drill several feet up through the mine roof. After a hole is placed in the roof, an epoxy resin in a pliable plastic tube is inserted in the hole. Next, a roof bolt is placed in the hole, and the placing of the roof bolt tears the packaging for the epoxy resin and mixes said resin to the bolt itself and the surrounding rock layers. The epoxy resin typically "sets up" or hardens within a matter of seconds and the bolt and rock layers are thereby sealed to each other.

In most underground mining situations, a roof bolt is placed approximately every four feet in the mine. Accordingly, placement of roof support is a major undertaking and a major source of expense for the mine operator. Despite the cost, roof bolt/epoxy combinations are the most effective and practical means for providing primary roof support, and fully meet the requirements promulgated by MSHA and various state enforcement authorities.

A number of prior art patents disclose and/or claim methodology for installing roof bolts in rock strata. These include U.S. Pat. No. 4,704,053 to Hipkins, U.S. Pat. No. 5,073,065 to Kleineke, and U.S. Pat. No. 5,417,520 to Rastall among others. U.S. Pat. No. 4,784,530 to Price, Jr. discusses the history of resin-based anchoring systems and identifies a number of other key prior art patents. Yet the prior art methods feature a number of serious drawbacks.

A key limitation to the effectiveness of resin-based systems is the presence of drawrock. Drawrock refers to thin layers of shale, one inch to twenty inches thick, which is frequently found throughout the United States immediately adjacent and above seams of coal. In such scenarios, as coal is mined, the immediate roof material may consist of several inches or feet of shale or drawrock.

Shale is typically very hard in the compressed state, and a mine roof characterized by shale usually is a very stable roof when the mine is first opened and the adjoining seam of coal first removed. However, when shale is exposed to the elements, i.e. moisture, the characteristics of the rock begin to change. Over a period of time, wet shale will begin to deteriorate into drawrock, and the layers of rock will separate. As this occurs, the lower, exposed layers will crumble and begin flaking off and dropping. It is quite typical that the inside of an underground mine will be wet, and often a substantial amount of water will be encountered. Accordingly, drawrock can be a major problem in a wet underground mine which is characterized by a shale roof or upper walls. While primary roof control is normally quite effective in securing various strata of rock together for three to six foot lengths, crumbling drawrock in the lower layer can undermine the protection.

A roof bolt properly anchored in an epoxy-based resin effectively supports the roof because it applies upward pressure to hold the various strata of rock together in an essentially compressed state. At the exposed end of the bolt, a base plate, typically 8 inches by 8 inches, is anchored against the roof by the bolt. This base plate supports the lowest roof layer while the bolt anchors the lower strata to upper strata of rock.

The presence of drawrock can seriously undermine a primary roof support system. If the immediate roof layer (just above the base plate) is drawrock, deterioration of the drawrock by environmental conditions can result in a crumbling of the roof in the vicinity of the base plate. Accordingly, the rock layer just about the base plate may crumble and flake away over time. When this occurs, the roof support system is compromised because in order for the system to be effective, the base plate must be applying pressure against the lower strata of rock anchoring them to upper rock layers. If drawrock crumbles in the vicinity of the base plate, the roof support system at that point consists only of a bolt in epoxy glueing the upper strata together. No pressure is being applied by the base plate. This may result in the lower rock strata becoming loose and falling.

State and Federal mine inspection officials are aware that the presence of drawrock can undermine a roof bolt support system in an underground mine. When the presence of drawrock results in a flaking away of the rock strata just above the base plate, inspection officials will require the mine operator to install another roof bolt or provide some other means for achieving primary roof support in that vicinity. For the mine operator, this is a very expensive problem, because it means the operator will have to bring a roof bolter into this area of the mine to install a new bolt. Since the drawrock deterioration may occur months or years after the installation of the initial roof bolt, roof bolters are typically nowhere near the area of the mine in which drawrock has created the need to re-install a bolt. The manpower requirements to move a roof bolt installation machine from remote areas of the mine back to areas previously mined may result in considerable downtime. However, the work has to be done because the drawrock damaged area of the mine is essentially devoid of primary roof support and the dangers associated with this condition are unacceptable.

The danger is even more pronounced considering that the older portions of the mine, where roof bolts were installed years earlier, are now typically passageways for access to new work areas of the mine. As such, it may be a major traffic thoroughfare for miners and equipment. A crumbling of the ceiling in this area, therefore, can result in a localized roof fall in a part of the mine more likely to affect personnel and equipment.

Prior art patents and methods have failed to appropriately address this problem. Those methods that have been so directed are generally ineffective or are too complicated to be practical. Perhaps the closest prior art to the present invention is found with U.S. Pat. No. 5,733,069 to Schofield, Jr. That patent discloses a re-tensioning apparatus for use with roof bolts in underground mines using an externally threaded split bushing. Essentially, a pair of threaded members are wrapped on a roof bolt shaft and an oversized spacer is placed around the bushings. A threaded nut is tightened upon the bushings and thereby urges the spacer toward the mine roof. However, the Schofield design suffers from key limitations. For one, the orientation of two separate threaded bushings means the thread path is not continuous which compromises the lift capacity of the article. Stripping of the threads is common with two separate threaded members. The problem is compounded, of course, by the fact that the roof bolt shaft is generally not smooth. In addition, the Schofield device is inconvenient to use since it requires that both bushings be held in place as the nut is being tightened. In most cases, this will require the service of two workers to complete the installation whereas the present invention can be installed by a single employee.

The need for a new method is more paramount when considering that some portions of an open mine cannot be accessed by a roof bolter without closing the entire mine. For example, if a conveyor belt has been placed in a portion of a mine passageway, one cannot relocate a roof bolter into that passageway to replace roof bolts unless the conveyor belt is removed. In some areas, wooden cribbing material or other structures might also have to be moved at considerable cost. In addition, some areas of the mine, due to moisture or traffic, may have experienced a softening of the mine floor such that the floor cannot support the added weight of roof bolting machinery in the area. In such a circumstance, the mine operator would be forced to excavate the soft floor material and replace it with rock or concrete in order to build up a floor that will support the roof bolting equipment. Of course, during the period of time that the floor is being repaired or poured, the workers are exposed to the weakened roof condition that precipitated the need for repairs in the first place.

For the reasons noted above, a substantial need exists for a method and apparatus which can achieve a re-tensioning of a previously loosened roof bolt such that installation of a replacement bolt is not necessary.

SUMMARY OF THE INVENTION

The object of this invention is to provide a method and apparatus for re-tightening a roof bolt that has become compromised as a result of localized crumbling or deterioration of rock strata in the vicinity of the base plate of a roof bolt. This objective is achieved by the apparatus of the present invention which couples with a previously placed roof bolt and re-applies pressure to the base plate against the mine roof such as to replace the pressure lost by the crumbling of the lower rock level. The apparatus is generally comprised of a slotted nut, slotted screw, and one or more slotted spacer as the essential hardware. The apparatus serves to direct the roof bolt base plate upward to compress the ceiling, essentially operating as a spacer between the bolt and plate. By re-applying an upward pressure on the roof, the integrity of the roof bolt is resurrected.

Another primary objective of the present invention is to provide a re-tightened primary mine roof support system that is as effective at supporting the roof as the original roof bolt and is durable enough to withstand physical pressure as well as environmental challenges such as moisture, including acidic moisture, dust, and heavy equipment access. Yet another object of this invention is to create a device for primary mine roof support which is inexpensive to manufacture, inexpensive to install, and increases the life expectancy of roof bolt support system. In addition, a further object of the invention is to create a re-tightened primary mine roof support system that does not require frequent maintenance or replacement of component parts. Specifically, it is desired that the apparatus disclosed in this invention should have a life expectancy in excess of the original roof bolt. Furthermore, the apparatus of this invention is capable of re-use, such that if an area of the mine is to be abandoned and sealed, the apparatus can be removed from the roof bolt to which it is attached, and reused at some other area of the mine.

Another primary objective of the present invention is to provide an apparatus for secondary mine roof support that is easy to transport into location in the mine, and which avoids the necessity of moving a roof bolting machine into a remote area of the mine to re-bolt previously bolted areas. The apparatus of this invention can be easily installed by one employee and does not require the use of heavy motorized equipment to install. Accordingly, this invention serves to reduce both the costs and personnel difficulty involved in re-bolting a mine roof such as to increase the likelihood that the affected areas will be repaired.

Another objective of this invention is to create an apparatus and method for repairing a primary mine roof support system that has been compromised that can be quickly implemented. When a weakened mine roof is discovered, it is imperative that remedial measures be taken very quickly. With the prior art method, much time is lost waiting for the roof bolter to be transported back to the affected area of the mine. This delay constitutes a risk of a roof fall and such risk can be eliminate with the present method and device.

As discussed above, the method and device of the present invention overcomes the disadvantages inherent in prior art methods and devices. In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Accordingly, those skilled in the art will appreciate that the conception upon which this invention is based may readily be utilized as a basis for the design of other structures, methods, and systems for carrying out the several purposes of the present invention. It is important, therefore, that the claims be regarded as including such equivalent constructions insofar as they do not depart from the spirit and scope of the present invention.

Furthermore, the purpose of the forgoing Abstract is to enable the U.S. Patent and Trademark Office and the public generally, and especially including the practitioners in the art who are not familiar with patent or legal terms or phraseology, to determine quickly from a cursory inspection the nature and essence of the technical disclosure of the application. The Abstract is neither intended to define the invention of the application, nor is it intended to be limiting to the scope of the invention in any way.

BRIEF DESCRIPTION OF THE DRAWINGS

Additional utility and features of this invention will become more fully apparent to those skilled in the art by reference to the following drawings, wherein all components are designated by like numerals and described more specifically.

DETAILED DESCRIPTION OF THE INVENTION

Figure 1:
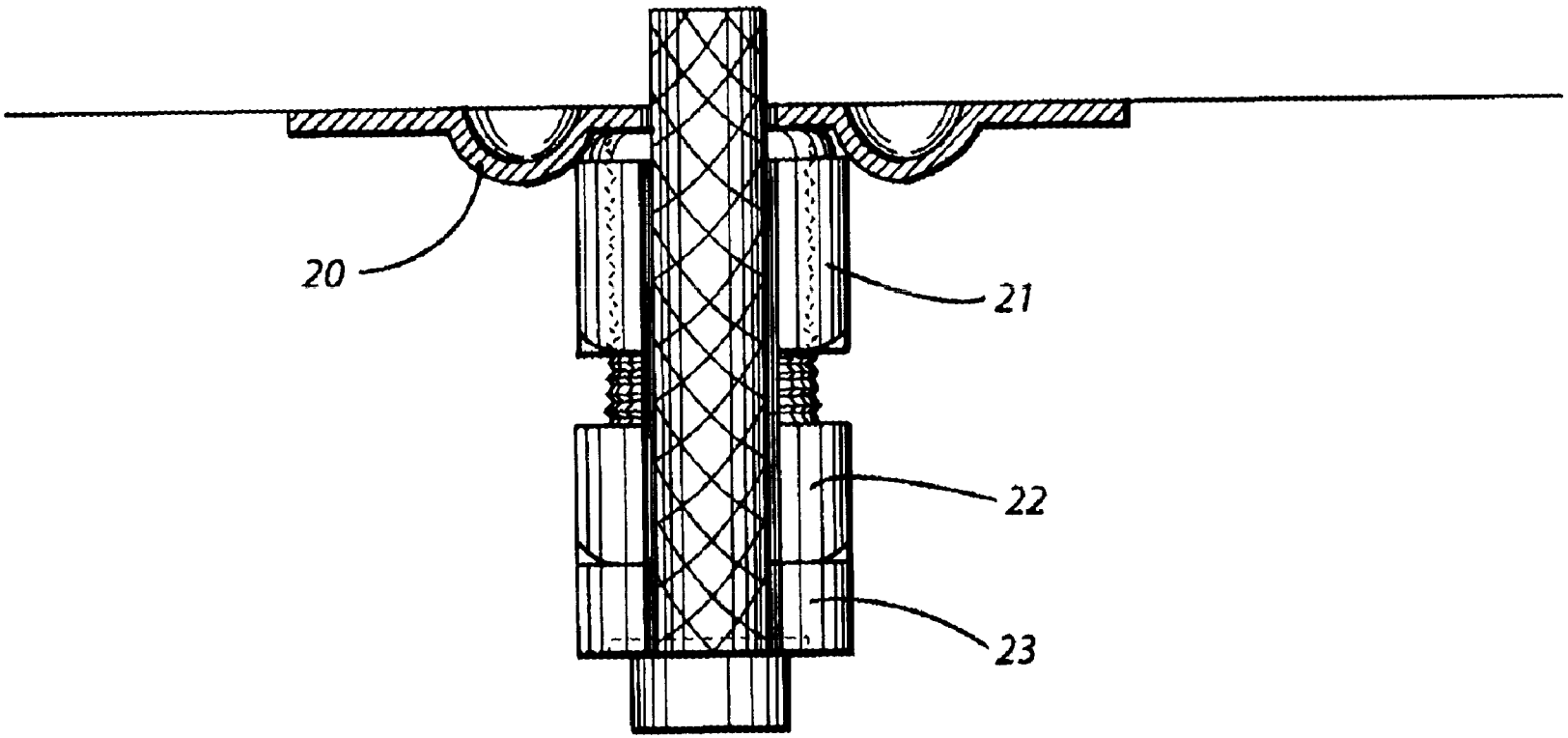
FIG. 1 is a side view of the preferred embodiment of an assembled unit of the present invention compressing a roof plate against a mine ceiling in accordance with this invention.

FIG. 1 shows an assembled unit of the preferred embodiment of the apparatus of the present invention in use to re-tighten a roof bolt in accordance with the method of the present invention. FIG. 1 shows roof plate 20 (not an element of the present invention) compressed against a mine roof by the apparatus of the present invention. The system includes a slotted nut 21 pressed against the roof plate 20 by the threads of the slotted screw member 22 and slotted spacer 23. No scale is shown in FIG. 1 as the apparatus and method of the present invention can be employed to re-tighten a roof bolt from a minimum of approximately 3 inches to a maximum of 2 feet. The distance to which the bolt is tightened is primarily limited only by the impracticality of a 2 foot section of tightened roof bolt extending into the passageway of an open mine.

Figure 3:
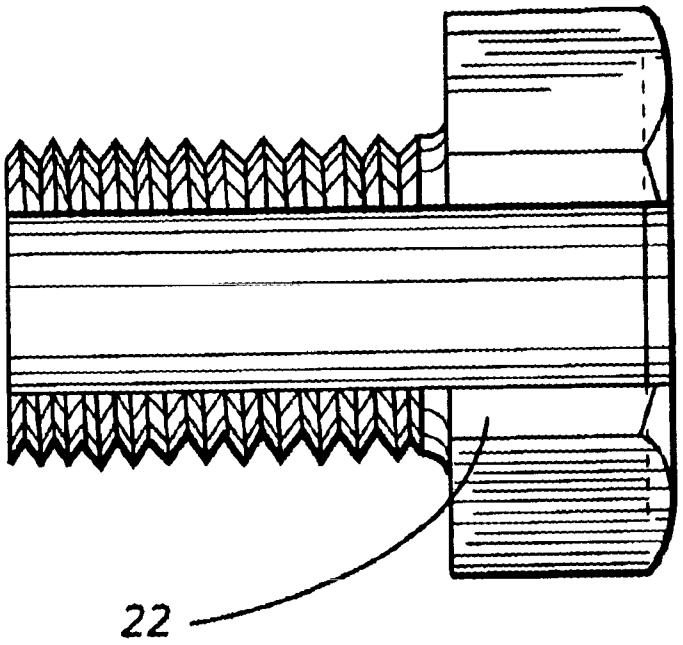
FIG. 3 is a side view of the slotted screw member of the preferred embodiment, in accordance with this invention.
Figure 2:
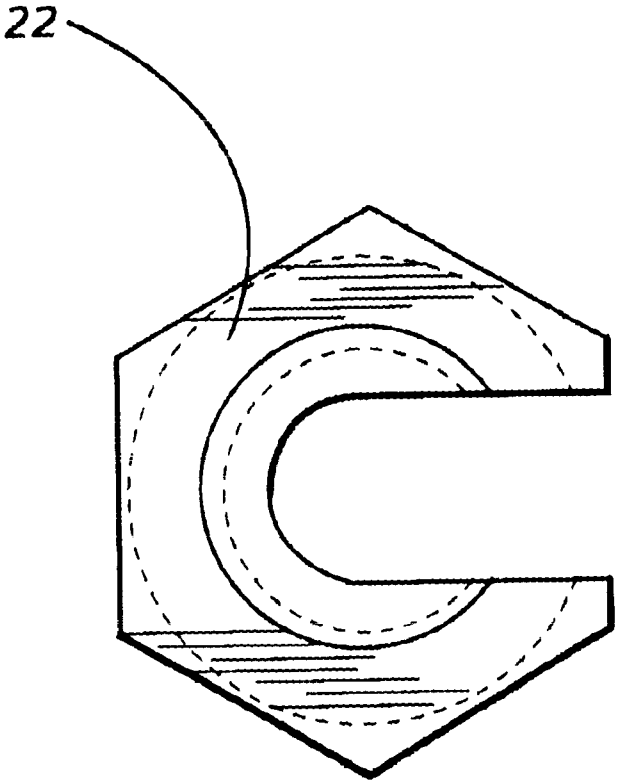
FIG. 2 is a bottom view of the slotted screw member of the preferred embodiment, in accordance with this invention.

FIG. 2 and FIG. 3 show the slotted screw member 22 of the present invention. As noted in FIG. 2, the preferred embodiment of the slotted screw 22 features a screw head that is 2¼ inches across the flats of the screw head, which provides a dimension that will effectively facilitate substantial tightening leverage when a monkey wrench or other tightening device is used across the screw head. FIG. 2 also notes the slotted area of the screw to be ⅞ inches in width. Other dimensions are also possible; however, the ⅞ inch size is optimum for use on a ⅝ or ¾ inch roof bolt, the two most prevalent sizes of roof bolts commercially available in the United States. The slotted screw can be constructed of a variety of metals, and is optimally constructed of steel or stainless steel.

FIG. 3 shows a side view of the slotted screw member 22 of the present invention. As noted in the figure, the slotted screw member 22 features a head portion 30 approximately 1 inch in thickness followed by a threaded portion, shown in the figure to be 2 inches long, and also featuring a ⅞ inch slotted aperture. The threads of the screw member 22 are approximately 6 threads per inch as featured in FIG. 3, but other arrangements are possible. FIG. 3 also shows a recessed area 32 measuring 2⅛ inch diameter in the top face of the head portion of the slotted screw member. This recessed area is included for the purpose of providing an appropriate seat such as to couple the slotted screw member 22 with the slotted spacer 23. The recessed area 32 is approximately 0.1 inch deep on the head of the screw.

Figure 5:
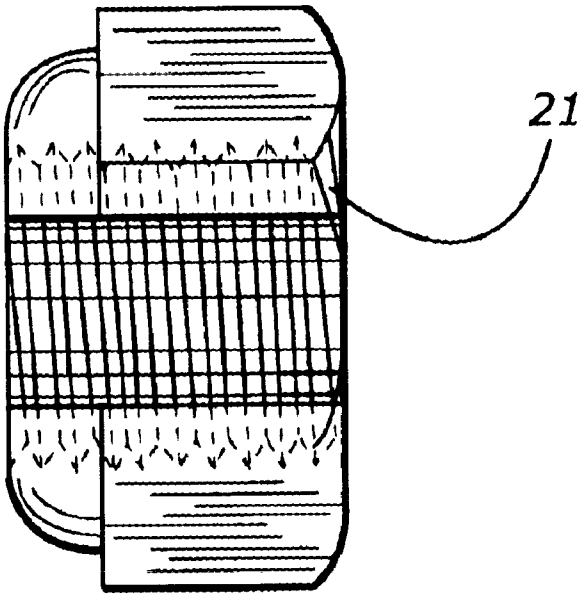
FIG. 5 is a side view of the slotted nut of the preferred embodiment of the present invention.
Figure 4:
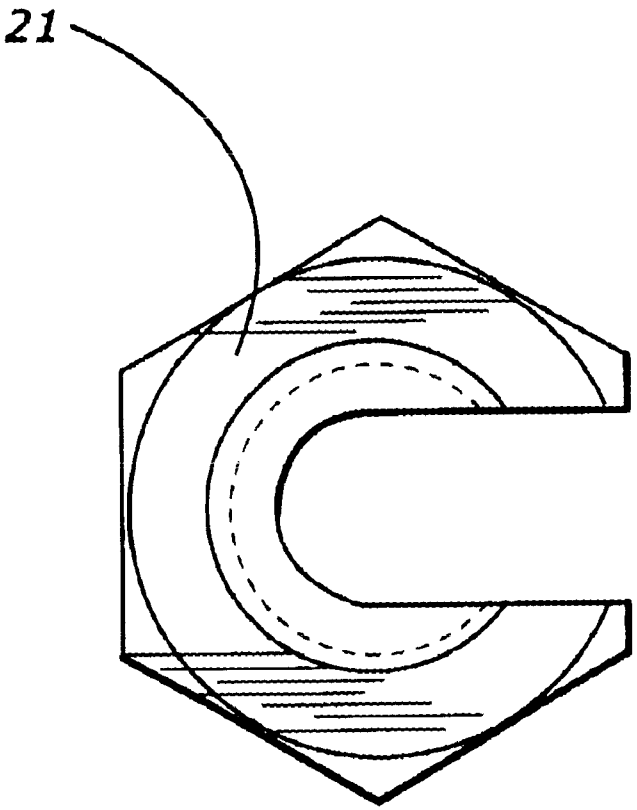
FIG. 4 is a bottom view of the slotted nut of the preferred embodiment of the present invention.

FIG. 4 and FIG. 5 show the preferred embodiment of the slotted nut 21 of the present invention. As shown in FIG. 4, the dimension of the slotted nut is 2¼ inches across the flats of the nut, and it features a ⅞ inch slotted area, which facilitates sliding the nut 21 onto the roof bolt shaft from the side. As shown in FIG. 5, the slotted nut 21 is approximately 1.45 inches in overall length and features number 6 threads machined such as to effectively couple with the aforementioned slotted screw member 22. The slotted nut 21 also features an area approximately 0.375 inches in overall length which is machined to a ⅜ inch radius as shown in FIG. 5. The machined portion of the slotted nut 21 serves the purpose of allowing the nut and overall re-bolt assembly to lock onto and couple with the top of the roof plate 20. With the apparatus in place, the nut will be screwed up the bolt shaft until the roof plate 20 is firmly pressed against the mine roof restoring support and effectiveness to the primary roof support system in that area.

Figure 7:
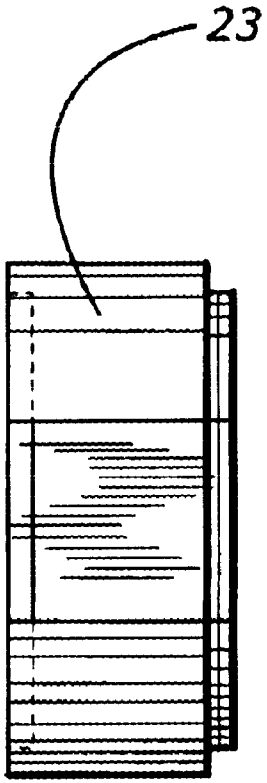
FIG. 7 is a side view of the slotted spacer of the preferred embodiment of the present invention.
Figure 6:
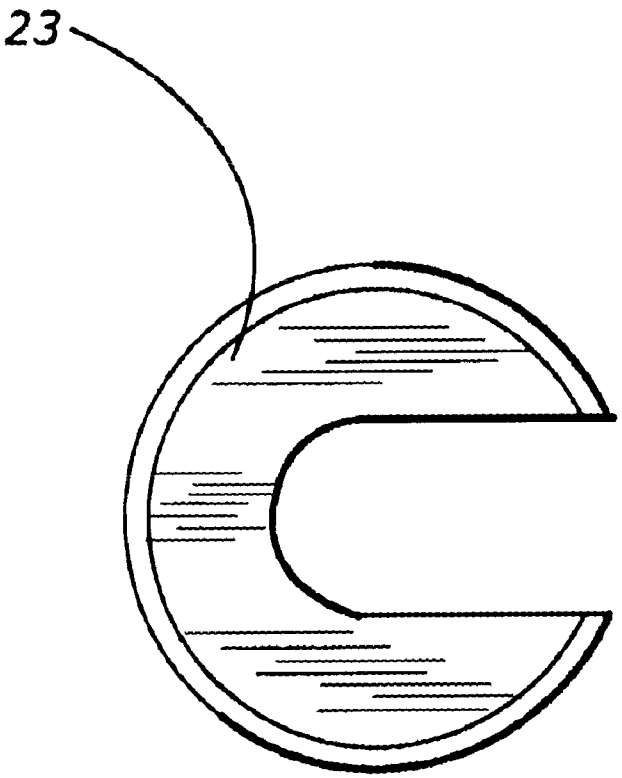
FIG. 6 is a bottom view of the slotted spacer of the preferred embodiment of the present invention.

FIG. 6 and FIG. 7 show the slotted spacer element 23 of the preferred embodiment of the present invention. As shown in FIG. 6, the slotted spacer element 23 is approximately 2¼ inches in overall diameter and, like the other elements of the invention, features a ⅞ inch slotted area to facilitate attachment to an exposed roof bolt from the side. As shown in FIG. 6 but more effectively in FIG. 7, slotted spacer 23 also features a machined area of approximately 0.1 inches such as to create a recessed area by which the spacer can effectively couple and lock with the head of the roof bolt 20. Note that the recessed area is approximately 2 inches in diameter to facilitate such coupling. FIG. 7 also shows an extended area of the slotted spacer 23 of approximately 0.1 inches such that this extended portion of the spacer will effectively couple with the head of slotted screw member 22 described earlier. FIG. 7 also notes that the dimension (A) is variable depending on the area by which the present invention is needed to effectively re-tighten the roof bolt. Accordingly, dimension (A) may range from ½ inch to several inches.

The method of the present invention consists of the steps of coupling together the slotted nut and slotted screw member such as to thread the nut upon the screw member. The slotted aperture is lined up on the coupled elements such that the combination can be slid onto the roof bolt between the exposed head of the roof bolt and the roof plate or base plate. In one embodiment of the method, no spacer is utilized. In a second embodiment method, one or more slotted spacers is placed on the roof bolt between the head of the screw member and the head of the roof bolt. The orientation of the slotted aperture is such that the spacer(s) 23, screw member 22, and nut 21 elements may easily be placed. As mentioned earlier, the spacers are utilized to the extent necessary to provide an effective absorption of the excess exposed roof bolt. Next, the slotted nut is twisted such that the nut is moved in the opposite direction of the screw head such as to tighten the nut against the spacer and head of the roof bolt. Consequently, the elements are securely and appropriately fastened such that the roof bolt is again providing effective roof support.

I claim:

1. A re-tensionable roof bolt assembly for anchoring a rock strata in an underground mine, comprising:

a. a roof plate with an opening formed therein;

b. a roof bolt consisting of a head and a shaft, said roof bolt shaft inserted through said opening in said roof plate and inserted into a bore hole in said rock strata along with a quick-setting resin;

c. a screw member oriented between said roof plate and the head of said roof bolt, said screw member consisting of an externally threaded portion and a head portion, said screw member further defined to include a central bore having a diameter slightly larger than the diameter of said roof bolt shaft and a slotted first aperture of the same diameter extending radially from said central bore to the exterior of said screw member and extending the full length of both said externally threaded portion and head portion of said screw member thereby effecting a slotted opening; and d. an internally threaded nut having first and second parallel faces and a plurality of outer sides extending between said faces to define a surface for the application of force to turn said nut, further defined to include a central bore through said nut perpendicular to said first and second face and featuring a continuous internal thread adapted and sized to complement the threaded portion of said screw member, and wherein said nut is further defined to include a slotted second aperture approximately identical in size and diameter to said slotted first aperture in said screw member.

2. A re-tensionable roof bolt assembly for anchoring a rock strata in an underground mine, comprising:

a. a roof plate with an opening formed therein;

b. a roof bolt consisting of a head and a shaft, said roof bolt shaft inserted through said opening in said roof plate and inserted into a bore hole in said rock strata along with a quick-setting resin;

c. a screw member oriented between said roof plate and the head of said roof bolt, said screw member consisting of an externally threaded portion and a head portion, said screw member further defined to include a central bore having a diameter slightly larger than the diameter of said roof bolt shaft and a slotted first aperture of the same diameter extending radially from said central bore to the exterior of said screw member and extending the full length of both said externally threaded portion and head portion of said screw member thereby effecting a slotted opening;

d. an internally threaded nut having first and second parallel faces and a plurality of outer sides extending between said faces to define a surface for the application of force to turn said nut and a central bore through said nut perpendicular to said first and second face and featuring a continuous internal thread adapted and sized to complement the threaded portion of said screw member, and wherein said nut is further defined to include a slotted second aperture approximately identical in size and diameter to said slotted first aperture in said screw member;

e. at least one spacer having first and second parallel faces and an outer edge perpendicular to and extending between said first and second faces, said spacer further defined to include a central bore and slotted aperture approximately identical in size and diameter to said central bore and slotted aperture in said screw member.

3. The assembly of claim 2 wherein said spacer features an annular recess in said first parallel face dimensioned to couple the head of said roof bolt such that said roof bolt head is nested in said recess upon re-tensioning of the roof bolt.

4. The assembly of claim 2 wherein said head portion of said screw member is further defined to include a plurality of outer sides radially extensive from said threaded portion such as to define a surface for the application of force for turning said screw member away from said internally threaded nut.

5. The assembly of claim 4 wherein said head portion of said screw member is further defined to include an end portion perpendicular to said threaded portion, said end portion characterized by an annular recess, and wherein said one or more spacers is further defined such that said outer edge features a region of reduced diameter in the vicinity of said second parallel face such that said region of reduced diameter couples closely with said annular recess in said head portion of said screw member upon re-tensioning of the roof bolt.

6. The assembly of claim 5 wherein said internally threaded nut is further defined to include a region of reduced circumference in the vicinity of said second parallel face, and further defined such that said second parallel face includes a rounded edge for optimal coupling against a roof bolt plate during re-tensioning of the roof bolt.

7. A method for re-tensioning a roof plate in an underground mine wherein said roof plate is held by a fixed roof bolt, said roof bolt having a head and a shaft, comprising:

a. coupling a screw member consisting of an externally threaded portion and a head portion and featuring a central bore having a diameter slightly larger than the diameter of said roof bolt shaft and a slotted aperture of the same diameter extending radially from said central bore to the exterior of said screw member and extending the full length of both said externally threaded portion and said head portion of said screw member, with an internally threaded nut having first and second parallel faces and a plurality of outer sides extending between said faces to define a surface for the application of force to turn said nut and a bore through said nut perpendicular to said first and second face and featuring a continuous internal thread adapted and sized to complement the threaded portion of said screw member, wherein said nut further features a slotted aperture approximately identical in size and diameter to said slotted aperture in said screw member;

b. placing said coupled screw member and nut around the roof bolt shaft by orienting the slotted aperture around said roof bolt shaft, with the head portion of said screw member oriented toward said roof bolt head while said nut is oriented toward the roof plate of said mine roof; and c. turning said nut away from said head portion of said screw member such as to bias said base plate against said mine roof, re-tightening said roof bolt.

8. A method for re-tensioning a roof plate in an underground mine wherein said roof plate is held by a fixed roof bolt, said roof bolt having a head and a shaft, comprising:

a. coupling a screw member consisting of an externally threaded portion and a head portion and featuring a central bore having a diameter slightly larger than the diameter of said roof bolt shaft and a slotted first aperture of the same diameter extending radially from said central bore to the exterior of said screw member and extending the full length of both said externally threaded portion and head portion of said screw member, with an internally threaded nut having first and second parallel faces and a plurality of outer sides extending between said faces to define a surface for the application of force to turn said nut and bore through said nut perpendicular to said first and second face and featuring a continuous internal thread adapted and sized to complement the threaded portion of said screw member, wherein said nut further features a slotted second aperture approximately identical in size and diameter to said slotted first aperture in said screw member;

b. placing said coupled screw member and nut around the roof bolt shaft by orienting the slotted aperture around said roof bolt shaft, with the head portion of said screw member oriented toward said roof bolt head while said nut is oriented toward the roof plate of said mine roof; and c. placing a spacer having first and second parallel faces and an outer edge perpendicular to and extending between said first and second faces, said spacer further defined to include a central bore and slotted aperture identical in size and diameter to said slotted aperture in said screw member, between said roof bolt head and said screw member head portion; and d. turning said nut away from said head portion of said screw member such as to bias said roof plate against said mine roof, re-tightening said roof bolt.

9. An apparatus for re-tensioning a fixed roof bolt in an underground mine, said roof bolt having a head and a shaft, said apparatus comprising:

a. a screw member consisting of an externally threaded portion and a head portion, said screw member further defined to include a central bore having a diameter slightly larger than the diameter of said roof bolt shaft and a slotted first aperture of the same diameter extending radially from said central bore to the exterior of said screw member and extending the full length of both said externally threaded portion and head portion of said screw member thereby effecting a slotted opening;

b. an internally threaded nut having first and second parallel faces and a plurality of outer sides extending between said faces to define a surface for the application of force to turn said nut and a central bore through said nut perpendicular to said first and second face and featuring a continuous internal thread adapted and sized to complement the threaded portion of said screw member, and wherein said nut is further defined to include a slotted second aperture approximately identical in size and diameter to said slotted first aperture in said screw member;

c. at least one spacer having first and second parallel faces and an outer edge perpendicular to and extending between said first and second faces, said spacer further defined to feature an annular recess in said first parallel face dimensioned to couple the head of said roof bolt such that said roof bolt head is nested in said recess upon re-tensioning of the roof bolt.

10. The apparatus of claim 9 wherein said head portion of said screw member is further defined to include a plurality of outer sides radially extensive from said threaded portion such as to define a surface for the application of force for turning said screw member away from said internally threaded nut.

11. The apparatus of claim 10 wherein said head portion of said screw member is further defined to include an end portion perpendicular to said threaded portion, said end portion characterized by an annular recess, and wherein said one or more spacers is further defined such that said outer edge features a region of reduced diameter in the vicinity of said second parallel face such that said region of reduced diameter couples closely with said annular recess in said head portion of said screw member upon re-tensioning of the roof bolt.

12. The apparatus of claim 11 wherein said internally threaded nut is further defined to include a region of reduced circumference in the vicinity of said second parallel face, and further defined such that said second parallel face includes a rounded edge for optimal coupling against a roof bolt plate during re-tensioning of the roof bolt.

* * * * *